US008879945B2

(12) United States Patent
Fujiya et al.

(10) Patent No.: US 8,879,945 B2
(45) Date of Patent: Nov. 4, 2014

(54) COOLING DEVICE AND IMAGE FORMING APPARATUS

(75) Inventors: Hiomitsu Fujiya, Kanagawa (JP); Satoshi Okano, Kanagawa (JP); Tomoyasu Hirasawa, Kanagawa (JP); Masanori Saitoh, Tokyo (JP); Keisuke Ikeda, Kanagawa (JP); Kenichi Takehara, Kanagawa (JP); Yasuaki Iijima, Kanagawa (JP); Keisuke Yuasa, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 414 days.

(21) Appl. No.: 13/415,200

(22) Filed: Mar. 8, 2012

(65) Prior Publication Data

US 2012/0227927 A1 Sep. 13, 2012

(30) Foreign Application Priority Data

Mar. 8, 2011 (JP) ..... 2011-050059
Sep. 26, 2011 (JP) ..... 2011-208534

(51) Int. Cl.

| | |
|---|---|
| ***G03G 21/20*** | (2006.01) |
| ***F28F 27/00*** | (2006.01) |
| ***G03G 15/08*** | (2006.01) |
| ***F28D 15/00*** | (2006.01) |
| *F28D 21/00* | (2006.01) |

(52) U.S. Cl.

CPC ..... *F28F 27/00* (2013.01); *G03G 21/206* (2013.01); *G03G 15/0896* (2013.01); *G03G 21/20* (2013.01); *F28D 15/00* (2013.01); *F28D 2021/0028* (2013.01)

USPC ..... 399/94

(58) Field of Classification Search

USPC ..... 399/94

See application file for complete search history.

(56) References Cited

U.S. PATENT DOCUMENTS

| | | | |
|---|---|---|---|
| 8,036,564 | B2 | 10/2011 | Takehara |
| 8,068,759 | B2 | 11/2011 | Takehara et al. |

(Continued)

FOREIGN PATENT DOCUMENTS

| | | |
|---|---|---|
| JP | 3047889 | 2/1998 |
| JP | 2007-24985 | 2/2007 |

OTHER PUBLICATIONS

U.S. Appl. No. 13/427,048, filed Mar. 22, 2012, Fujiya, et al.

*Primary Examiner* — Walter L Lindsay, Jr.
*Assistant Examiner* — Barnabas Fekete
(74) *Attorney, Agent, or Firm* — Oblon, Spivak, McClelland, Maier & Neustadt, L.L.P.

(57) ABSTRACT

A cooling device includes a heat receiving unit arranged to contact with a cooling target to receive heat of the cooling target; a heat radiating unit configured to radiate heat of coolant; a tank configured to store therein the coolant; a circulating path configured to circulate the coolant through the heat receiving unit, the heat radiating unit, and the tank; a pump configured to transfer the coolant in the circulating path; and a liquid transfer detecting unit configured to detect liquid transfer of the coolant. The liquid transfer detecting unit includes a detector arranged above a liquid level of the coolant stored in the tank at a position where the coolant having flowed into the tank is hit when the coolant is transferred. The detector is arranged so as to be visible from the outside of the tank.

14 Claims, 4 Drawing Sheets

(56) References Cited

U.S. PATENT DOCUMENTS

2010/0008694 A1 1/2010 Okano et al.
2010/0008695 A1 1/2010 Okano et al.
2010/0183323 A1 7/2010 Fujiya et al.
2011/0030927 A1 2/2011 Okano et al.
2011/0052247 A1 3/2011 Saitoh et al.
2011/0052248 A1 3/2011 Nishimura et al.
2011/0052249 A1 3/2011 Iijima et al.
2011/0164896 A1 7/2011 Hirasawa et al.
2011/0170895 A1 7/2011 Fujiya et al.
2011/0188880 A1 8/2011 Suzuki et al.

COOLING DEVICE AND IMAGE FORMING APPARATUS

CROSS-REFERENCE TO RELATED APPLICATIONS

The present application claims priority to and incorporates by reference the entire contents of Japanese Patent Application No. 2011-050059 filed in Japan on Mar. 8, 2011 and Japanese Patent Application No. 2011-208534 filed in Japan on Sep. 26, 2011.

BACKGROUND OF THE PRESENT INVENTION

1. Field of the Present Invention

The present invention relates to a cooling device and an image forming apparatus including the cooling device.

2. Description of the Related Art

In an image forming apparatus such as a copying machine, a printer, a facsimile, or a MultiFunction Peripherals (MFP) including these, as methods for recording images like letters or symbols in a recording medium like paper or an OHP sheet, various methods are adopted. Among them, the electrophotography is widely used because it allows the high-speed formation of high-definition images. Generally, the image forming process in an electrophotographic image forming apparatus includes a step for scanning image information using an optical device, a step for writing an electrostatic latent image onto a photosensitive element based on the scanned image information, a step for forming a toner image on the photosensitive element with toner supplied from a developing device, a step for transferring the toner image formed on the photosensitive element to a recording medium, and a step for fixing the transferred toner image on the recording medium.

It is known that, when the above-described image forming process is performed, a temperature in the image forming apparatus is increased due to heat generated by the drive of various devices in the apparatus, thus causing various problems. For example, in the optical device, a scanner lamp for scanning an original or a scanner motor for driving the scanner lamp generates heat, while, in a writing device, a motor for rotating a polygon mirror at high speed generates heat. In the developing device, frictional heat is generated when toner is stirred for charging and, in a fixing device, a heater for heat-fixing a toner image generates heat. In the case of duplex printing, a recording medium heated by the fixing device is transferred to a conveying path for duplex printing, and thus a temperature surrounding the conveying path increases. Then, when such heat increases a temperature in the apparatus, toner is softened, thus causing a failed image. Moreover, when melted toner is solidified, a moving part in the developing device is locked, thus causing failure. The increase of a temperature also causes other problems such as the deterioration of oil on shaft bearings, etc., the shortening of the mechanical life of a motor, the malfunction or failure of an IC on an electric substrate, or the deformation of resin components having a low heat-resistant temperature. In order to prevent these problems caused by the increase of a temperature in the image forming apparatus, an air-cooling cooling device with a cooling fan, a duct, etc. is conventionally used for cooling.

However, with the higher-speed processing of printing, etc., the number of heating elements provided in the image forming apparatus has increased recently. The components of the image forming apparatus are more densified to achieve miniaturization and, with this tendency, the optimization of air flow design in the image forming apparatus becomes difficult. Consequently, heat tends to stay in the image forming apparatus. In response to the demand for energy saving, toner having a low melting temperature is developed to decrease energy consumption at the time of image fixing. The use of such toner having a low melting temperature requires further suppression of the increase of a temperature in the image forming apparatus. For these reasons, it is becoming difficult to obtain sufficient cooling effects with the conventional air-cooling system. Thus, as a cooling system having a higher cooling capacity, a liquid-cooling cooling device has been developed (see Japanese Patent Application Laid-open No. 2007-024985, for example).

Generally, a liquid-cooling cooling device includes a heat receiving unit arranged in a part whose temperature is increased in the image forming apparatus, a heat radiating unit for radiating heat of coolant, a circulating path for circulating coolant through the heat receiving unit and the heat radiating unit, and a pump for transferring coolant in the circulating path. The coolant is circulated by the pump through the heat receiving unit and the heat radiating unit, so that the heat radiating unit radiates heat absorbed by the heat receiving unit. Unlike the air-cooling cooling device, the liquid-cooling cooling device transfers heat through a liquid refrigerant (coolant) having a greater heat capacity than air. Thus, the liquid-cooling cooling device has higher heat-receiving properties and can efficiently cool a part whose temperature is increased.

Any joint left unfitted in the production process of a cooling device, for example, will lead to failure such as a case in which a manufactured cooling device cannot transfer liquid normally. Then, in order not to ship cooling devices with failure having occurred as they are, it is verified whether the manufactured cooling devices can transfer liquid normally. It is desirable to verify whether a cooling device transfers liquid normally when it is actually used.

Conventionally, as methods of verifying the liquid transfer of the cooling device, there exist a method of monitoring a load current value of the pump, a method with a flow meter provided in the circulating path of coolant, and a method with a detecting unit having a rotatable impeller called a flow monitor or a flow indicator (see Japanese Utility Model Registration No. 3047889) for verifying the liquid transfer by visual observation.

However, the method of monitoring a load current value of the pump involves the problem of high costs due to the increased number of circuits on a substrate, etc. Similarly, the mounting of a flow meter requires a liquid transfer detector and a circuit for amplifying detection signals of the detector, thus causing the problem of high costs.

By contrast, the method with a detecting unit having a rotatable impeller enables the detection of liquid transfer at low cost. However, the arrangement includes a movable part, and if bubbles are mixed into coolant and attached on the movable part, the coolant can form a bridge at the movable part. Then, when the bridging force generated at that time disables the operation of the movable part, the rotating action, etc. of the impeller is stopped, and it becomes impossible to verify the liquid transfer.

Therefore, there is a need for a cooling device capable of enabling easy verification of liquid transfer at low cost, and an image forming apparatus having the cooling device.

SUMMARY OF THE INVENTION

It is an object of the present invention to at least partially solve the problems in the conventional technology.

According to an embodiment, there is provided a cooling device that includes a heat receiving unit arranged to contact with a cooling target to receive heat of the cooling target; a heat radiating unit configured to radiate heat of coolant; a tank configured to store therein the coolant; a circulating path configured to circulate the coolant through the heat receiving unit, the heat radiating unit, and the tank; a pump configured to transfer the coolant in the circulating path; and a liquid transfer detecting unit configured to detect liquid transfer of the coolant. The liquid transfer detecting unit includes a detector arranged above a liquid level of the coolant stored in the tank at a position where the coolant having flowed into the tank is hit when the coolant is transferred. The detector is arranged so as to be visible from the outside of the tank.

According to another embodiment, there is provided a cooling device that includes a heat receiving unit arranged to contact with a cooling target to receive heat of the cooling target; a heat radiating unit configured to radiate heat of coolant; a tank configured to store therein the coolant; a circulating path configured to circulate the coolant through the heat receiving unit, the heat radiating unit, and the tank; a pump configured to transfer the coolant in the circulating path; and a liquid transfer detecting unit configured to detect liquid transfer of the coolant. The liquid transfer detecting unit includes a first detector arranged above a liquid level of the coolant stored in the tank at a position where the coolant having flowed into the tank is hit when the coolant is transferred and a second detector configured to detect hit of the coolant on the second detector.

According to still another embodiment, there is provided an image forming apparatus that includes the cooling device according to any one of the above embodiments.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
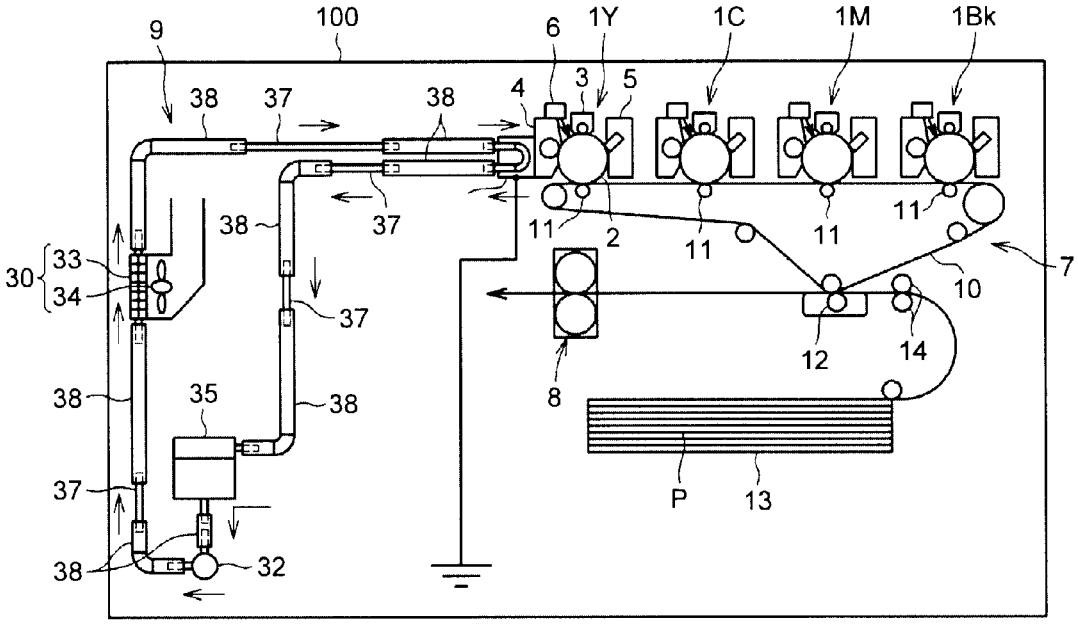
FIG. 1 is a schematic view illustrating the arrangement of a color image forming apparatus provided with a cooling device according to an embodiment of the present invention.

In the following, the present invention will be described with reference to the accompanying drawings. In each drawing, the same component or an equivalent thereof is indicated with the same reference numeral, and repeated explanation is appropriately simplified or omitted.

FIG. 1 is a schematic view illustrating the arrangement of a color image forming apparatus provided with a cooling device according to an embodiment of the present invention.

First, with reference to FIG. 1, the entire arrangement of the color image forming apparatus is described.

A color image forming apparatus 100 illustrated in FIG. 1 includes four image forming units 1Y, 1C, 1M, and 1Bk respectively forming images with different colors of yellow (Y), cyan (C), magenta (M), and black (Bk) corresponding to the color separation elements of color images. The image forming units 1Y, 1C, 1M, and 1Bk have the same arrangement except that each of them stores a different color of toner.

Specifically, each of the image forming units 1Y, 1C, 1M, and 1Bk has a drum-shaped photosensitive element 2 as a latent image carrier, a charging device 3 charging the surfaces of the photosensitive element 2, a writing device 6 forming an electrostatic latent image on the surface of the photosensitive element 2, a developing device 4 forming a toner image on the surface of the photosensitive element 2, and a cleaning device 5 cleaning the surface of the photosensitive element 2. In FIG. 1, the photosensitive element 2, the charging device 3, the writing device 6, the developing device 4, and the cleaning device 5 of the yellow-image forming unit Y are provided with reference numerals and, with regard to the other image forming units 10, 1M, and 1Bk, the reference numerals are omitted.

In the lower part of the drawing of each image forming unit 1Y, 10, 1M, and 1Bk, a transferring device 7 is arranged. The transferring device 7 has an intermediate transfer belt 10 constituted by an endless belt as a transfer member. The intermediate transfer belt 10 is laid across a plurality of rollers in a tensioned state. One of the rollers rotates as a drive roller, so that the intermediate transfer belt 10 moves around (rotates).

At the position facing the four photosensitive elements 2, four primary transfer rollers 11 as primary transfer means are arranged. Each of the primary transfer rollers 11 presses, at the corresponding position, the inner periphery surface of the intermediate transfer belt 10, and a primary transfer nip is formed at a portion at which the pressed part of the intermediate transfer belt 10 contacts with the corresponding photosensitive elements 2. Each of the primary transfer rollers 11 is connected to a power source (not illustrated), and a given direct current (DC) and/or a given alternating current (AC) is applied onto the primary transfer rollers 11.

At the position facing one of the rollers on which the intermediate transfer belt 10 is laid in a tensioned state, a secondary transfer roller 12 as secondary transfer means is arranged. The secondary transfer roller 12 presses the outer periphery surface of the intermediate transfer belt 10, and a secondary transfer nip is formed at a portion at which the secondary transfer roller 12 contacts with the intermediate transfer belt 10. Similarly to the primary transfer rollers 11, the secondary transfer roller 12 is connected to a power source (not illustrated), and a given direct current (DC) and/or a given alternating current (AC) is applied onto the secondary transfer roller 12.

The image forming apparatus 100 includes a paper feeding device 13 feeding a recording medium P such as paper or an OHP sheet to the secondary transfer nip, a pair of registration rollers 14 controlling the transfer timing of the recording medium P fed, and a fixing device 8 fixing an image onto the recording medium P.

With reference to FIG. 1, the image formation action of the image forming apparatus is described.

When the image formation action is started, the rotation of the photosensitive element 2 of each of the image forming units 1Y, 10, 1M, and 1Bk is driven, and the charging device 3 equally charges the surface of each photosensitive element 2 to given polarity. Based on image information of an original scanned by a scanning device (not illustrated), the writing device 6 irradiates the charged surface of each photosensitive element 2 with laser light so that an electrostatic latent image is formed on the surface of each photosensitive element 2. Here, the image information written on the surface of each photosensitive element 2 by the writing device 6 is single-color image information obtained by separating a desired full-color image to each color information of yellow, cyan, magenta, and black. Each developing device 4 feeds toner on the electrostatic latent image formed on the photosensitive element 2 as described above, thus developing (visualizing) the electrostatic latent image as a toner image.

The rotation of one of the rollers across which the intermediate transfer belt 10 is laid in a tensioned state is driven, so that the intermediate transfer belt 10 moves around. A constant voltage with polarity reverse of toner charging polarity or a constant-current controlled voltage is applied on each of the primary transfer rollers 11, and thus transfer electric fields are formed at the primary transfer nips between the respective primary transfer rollers 11 and the respective photosensitive elements 2. Then, due to the transfer electric fields formed at the primary transfer nips, the toner images of respective colors formed on the respective photosensitive elements 2 are overlapped sequentially on the intermediate transfer belt 10 for transfer. Consequently, the intermediate transfer belt 10 carries a full-color toner image on its surface. The toner on each photosensitive element 2 that cannot be sufficiently transferred to the intermediate transfer belt 10 is removed by the cleaning device 5.

When the image formation action is started, the paper feeding device 13 feeds the recording medium P. The pair of registration rollers 14 stops the fed recording medium P temporarily and then, at a controlled timing, transfers it to the secondary transfer nip between the secondary transfer roller 12 and the intermediate transfer belt 10. Here, a transfer voltage with polarity reverse of toner charging polarity of the toner image on the intermediate transfer belt 10 is applied on the secondary transfer roller 12, and thus a transfer electric field is formed at the secondary transfer nip. Then, due to the transfer electric field formed at the secondary transfer nip, the toner image on the intermediate transfer belt 10 is collectively transferred onto the recording medium P. Subsequently, the recording medium P is transferred to the fixing device 8, so that the toner image is fixed on the recording medium P. Then, the recording medium P is discharged to and stocked on a discharge tray (not illustrated) that is at the outside of the apparatus.

While the description above is of the image formation action to form a full-color image on a recording medium, any one of the four image forming units 1Y, 1C, 1M, and 1Bk may be used to form a single-color image, or two or three of them may be used to form a two-color or three-color images.

Next, the arrangement of the cooling device according to an embodiment of the present invention is described.

As illustrated in FIG. 1, in the image forming apparatus 100, a cooling device 9 for cooling a part whose temperature is increased in the image forming apparatus 100 is arranged. The cooling device 9 is of liquid cooling. Specifically, the cooling device 9 includes a heat receiving unit 31, a heat radiating unit 30, a pump 32, a tank 35, a plurality of metal pipes 37 and a plurality of resin tubes 38 that constitute a circulating path for connecting these components and circulating coolant. In the embodiment, the heat radiating unit 30 is provided with a radiator 33 and a fan 34 for sending air to the radiator 33. As coolant, an anti-freeze solution containing a rust-preventive agent, etc. is used.

Here, the cooling target cooled by the cooling device 9 is the developing device 4 of each of the image forming units 1Y, 1C, 1M, and 1Bk, and the heat receiving unit 31 is arranged so as to be in contact with the corresponding developing device 4. In FIG. 1, only the heat receiving unit 31 provided to the yellow-image forming unit 1Y is illustrated and, with regard to the other image forming units 10, 1M, and 1Bk, the illustration of the heat receiving unit 31 is omitted. The heat receiving unit 31 may be arranged so as to be in contact with a part whose temperature is increased other than the developing device 4, e.g., a scanning device (not illustrated), the photosensitive element 2, or the fixing device 8.

The cooling device 9 operates as follows.

The coolant cooled by the heat radiating unit 30 is transferred to the heat receiving unit 31 by the pump 32. Then, at the heat receiving unit 31, the heat of the developing device 4 is transmitted to the coolant, thus cooling the developing device 4. The coolant whose temperature is increased in the heat receiving unit 31 due to the heat from the developing device 4 is transferred, via the tank 35 and then the pump 32, to the heat radiating unit 30 again and cooled therein. In such a way, with the circulation of the coolant through the heat receiving unit 31 and the heat radiating unit 30, the cycle of heat absorption at the heat receiving unit 31 and heat radiation at the heat radiating unit 30 is repeated. As a result, the increase in temperature of the developing device 4 is suppressed, thereby avoiding the occurrence of abnormal images. The tank 35 serves as a storage tank for temporarily storing therein coolant from the radiator 33. Thus, the occurrence of great pressure fluctuation in the circulating path is prevented.

Figure 2:
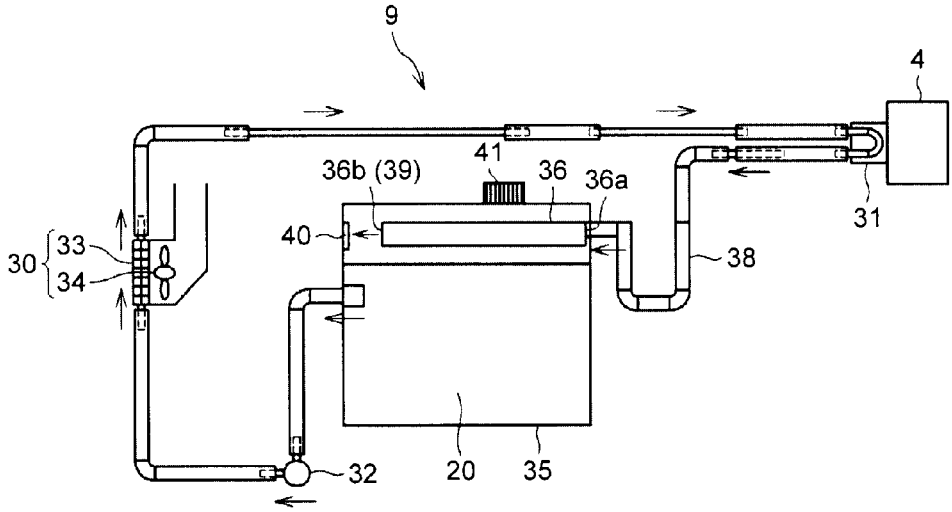
FIG. 2 is a schematic view illustrating the arrangement of the cooling device according to the embodiment of the present invention.

FIG. 2 is a schematic view illustrating the arrangement of the cooling device in which the tank is enlarged for illustration.

As illustrated in FIG. 2, in the tank 35, a resin liquid transfer pipe 36 is provided horizontally above the liquid level of stored coolant 20 that is stored in the tank 35. The resin tube 38 constituting the circulating path is connected to a proximal end 36*a* of the liquid transfer pipe 36, while a discharging port 39 discharging coolant is provided at a distal end 36*b* of the liquid transfer pipe 36. Thus, once the pump 32 is driven and the liquid transfer is started, coolant flows from the discharging port 39 of the liquid transfer pipe 36 into the tank 35. In the embodiment, the liquid transfer pipe 36 is provided horizontally. However, the direction of the liquid transfer pipe 36 is not limited to this, and the liquid transfer pipe 36 may be inclined relative to the horizontal plane. To the liquid transfer pipe 36, a material other than resin may be also applied.

The discharging port 39 of the liquid transfer pipe 36 is arranged so as to be close to the inner surface of the tank 35. On the inner surface of the tank 35 that faces the discharging port 39 above the liquid level of the stored coolant 20, a detecting unit 40 as the liquid transfer detecting unit is arranged. The detecting unit 40 is like a "target" hit by coolant discharged from the discharging port 39, and its form, material, etc. are not particularly limited. The detecting unit 40 may be of plane such as a mark put on the inner surface of the tank 35. However, depending on the angle from which the detecting unit 40 is visually observed, the visibility is improved by constituting the detecting unit 40 by a member having a certain thickness. In order to improve the visibility, the coolant may be colored with a color of red, green, etc.

The tank 35 is composed of a transparent or semi-transparent resin material so that the detecting unit 40 is visible from the outside. However, the whole of the tank 35 is not necessarily composed of a transparent or semi-transparent material. As long as the detecting unit 40 is visible from the outside, it is also possible that only one part of the tank 35 is composed of a transparent or semi-transparent material, or that a window is provided so as to allow visual observation of the inside of the tank 35. In FIG. 2, the reference numeral 41 indicates a removable cap on an opening (not illustrated) provided on the upper surface of the tank 35.

The distance between the distal end 36*b* of the liquid transfer pipe 36 and the detecting unit 40 can be determined by calculation using the following formula:

$$Y=(g/2V^2\times\cos^2\theta)\times X^2+\tan\theta X.$$

In the formula above, "Y" represents a distance in a vertical direction between the lower end of the distal end 36*b* (or the discharging port 39) of the liquid transfer pipe 36 and the lower end of the detecting unit 40, "X" a distance in a horizontal direction between the distal end 36*b* (or the discharging port 39) of the liquid transfer pipe 36 and the detecting unit 40, "V" an initial rate of coolant discharged from the discharging port 39, "θ" a discharge angle relative to the horizontal plane of the coolant discharged from the discharging port 39, and "g" gravitational acceleration. With the setting of values "Y" and "X" using the formula, it is possible to determine the distances in the vertical direction and in the horizontal direction between the distal end 36*b* of the liquid transfer pipe 36 and the detecting unit 40. It is preferable to set the values "Y" and "X" taking the visibility of the coolant discharged from the discharging port 39, the necessary flow rate of the coolant in the cooling device, etc, into consideration.

When a detecting unit for detecting the amount of the stored coolant 20 in the tank 35 based on the height of the liquid level is provided, if the cooling device is stopped but coolant flows from the upstream side of the tank 35 into the tank 35, the liquid level is changed, thus possibly causing troubles. Then, in such a case, as illustrated in FIG. 2, the resin tube 38 arranged in the upstream side of the tank 35 is connected to the liquid transfer pipe 36 such that the height position of the resin tube 38 is lower than the liquid level of the stored coolant 20 in the tank 35 temporarily. Thus, it is possible to prevent the above-described case in which coolant flows into the tank 35 after the cooling device is stopped.

Figure 3:
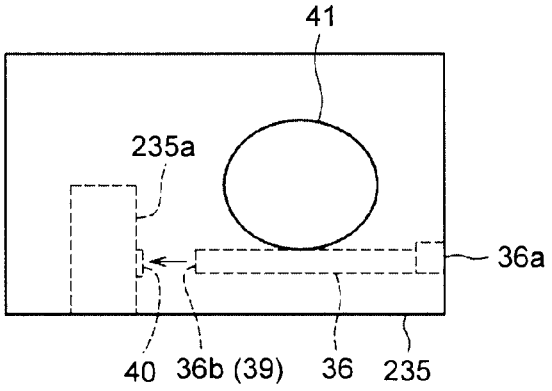
FIG. 3 is a plan view of a tank according to another embodiment of the present invention.
Figure 4:
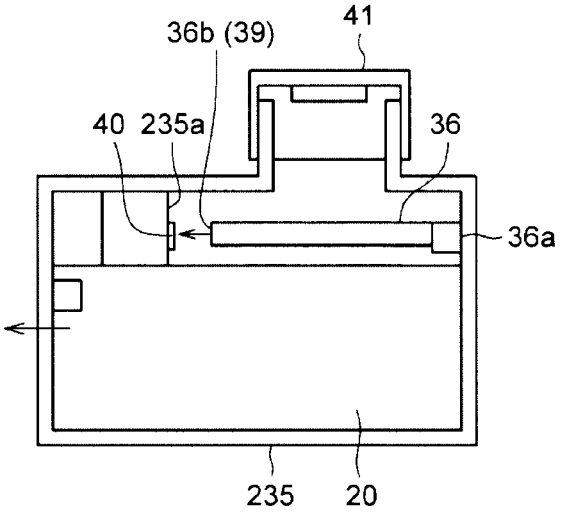
FIG. 4 is a sectional side elevation of the tank according to the embodiment of the present invention.

FIGS. 3 and 4 illustrate the arrangement according to another embodiment of the present invention.

FIG. 3 is a plan view of a tank according to another present embodiment, and FIG. 4 is a sectional side elevation thereof.

As illustrated in FIGS. 3 and 4, in the embodiment, one part of an inner surface of a tank 235 projects inward, and the detecting unit 40 is arranged on the projecting inner surface 235*a*. Similarly to what is described above, the discharging port 39 of the liquid transfer pipe 36 is arranged so as to face closely the detecting unit 40.

In such a way, in the embodiment illustrated in FIGS. 3 and 4, one part of the inner surface of the tank 235 projects inward, and the detecting unit 40 is arranged on the inner surface 235*a* projecting inward, thereby shortening the distance between the connecting portion of the liquid transfer pipe 36 to the tank 235 (the position of the proximal end 36*a*) and the detecting unit 40 and then allowing the shorter liquid transfer pipe 36 formed. Thus, it is possible to produce the device at lower cost. The shorter liquid transfer pipe 36 decreases the variation between "X" (a distance in the horizontal direction between the distal end 36*b* of the liquid transfer pipe 36 and the detecting unit 40) and "θ" (a discharge angle relative to the horizontal plane of the coolant discharged from the discharging port 39) in the formula above, thus making it possible that the coolant from the discharging port 39 hits the detecting unit 40 more stably, thereby improving detection accuracy. In the embodiment, the explanation for the arrangements other than the parts illustrated in FIGS. 3 and 4 is omitted because they are the same as in the above-described embodiment described with reference to FIGS. 1 and 2.

Figure 5:
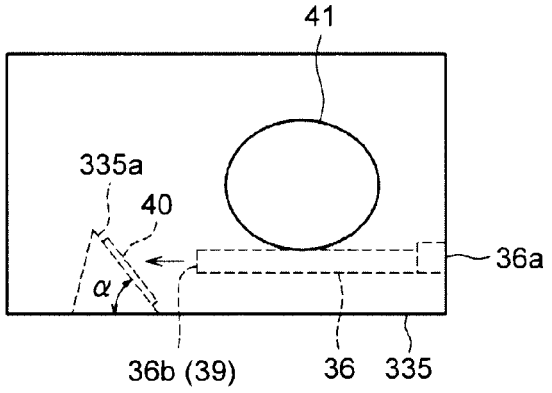
FIG. 5 is a plan view of a tank according to still another embodiment of the present invention.
Figure 6:
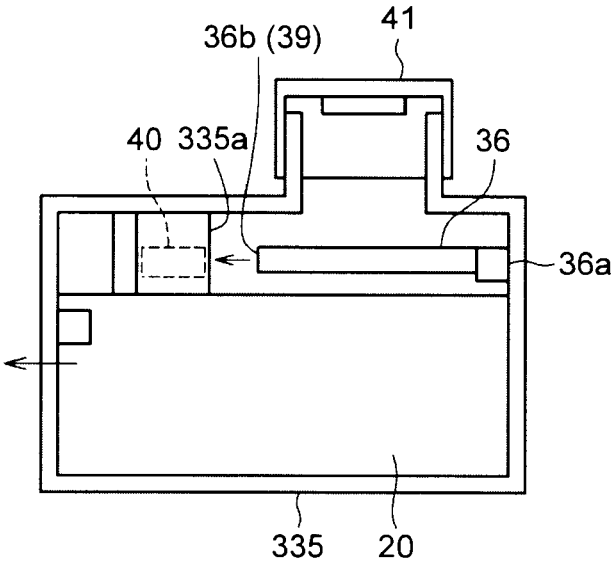
FIG. 6 is a sectional side elevation of the tank according to the embodiment of the present invention.

FIGS. 5 and 6 illustrate the arrangement of still another embodiment of the present invention.

FIG. 5 is a plan view of a tank according to the present embodiment, and FIG. 6 is a sectional side elevation thereof.

As illustrated in FIGS. 5 and 6, in the embodiment, one part of an inner surface of a tank 335 projects inward and, furthermore, the projecting inner surface 335*a* is inclined. More specifically, the inner surface 335*a* projecting inward is inclined in a discharge direction of coolant (the direction indicated by the arrow in FIG. 5). In FIG. 5, the surface not facing the discharging port 39 of the inner surface 335*a* projecting inward is also inclined in the discharge direction of the coolant. However, it is sufficient to incline only the surface facing the discharging port 39. The detecting unit 40 is arranged on the inner surface 335*a* faced by the discharging port 39. The other arrangements are the same as in the embodiment illustrated in FIGS. 3 and 4.

In such a way, in the embodiment illustrated in FIGS. 5 and 6, the detecting unit 40 is arranged on the inclined inner surface 335*a* of the tank 335, thus improving the visibility of the detecting unit 40 when it is observed from the side surface of the tank 335. In the example illustrated in FIG. 5, the visibility of the detecting unit 40 is improved especially when it is observed from the upper side of the drawing of the tank 335. The inner surface 335*a* on which the detecting unit 40 is arranged may be inclined in a direction so that which the detecting unit 40 is visible. Thus, the direction to which the inner surface 335*a* is inclined may be appropriately determined depending on a direction from which the detecting unit 40 is observed. As an inclination angle α of the inclined inner surface 35*a* in a discharge direction of coolant (see FIG. 5) is smaller, the visibility is improved more, while it becomes more difficult that the coolant hits the detecting unit 40. Therefore, it is preferable to determine the inclination angle α taking the trade-off between the visibility of the detecting unit 40 and easy hit of coolant on the detecting unit 40 into consideration.

In the arrangements of the above-described respective embodiments, when the coolant discharged from the discharging port 39 hits the detecting unit 40 and, at that time, bubbles of the coolant are generated due to the splash of the coolant, air can be mixed into the circulating path, thereby possibly causing bad influence on the cooling performance. Thus, it is desirable to provide a liquid splash suppressing unit for suppressing the splash of the coolant from hitting the detecting unit 40. Specifically, the liquid splash can be suppressed by constituting the detecting unit 40 by a member such as sponge, etc. The member constituting the detecting unit 40, and the member such as sponge, etc. as a liquid splash suppressing unit may be separately arranged.

When a liquid hit detector for automatically detecting the hit of coolant on the detecting unit 40 is provided, it becomes unnecessary to verify, by visual observation, whether the coolant hits the detecting unit 40. Thus, human errors can be avoided. As a specific arrangement, for example, the detecting unit 40 is constituted by a pressure-sensitive member changing its color due to the pressure generated when it is hit by coolant, and a color identifying sensor such as a photo interrupter for identifying the color change of the pressure-sensitive member is used as the liquid hit detector. In this case, it is possible, by identifying the color change of the pressure-sensitive member, to determine not only whether the coolant hits it but also the coolant flow rate.

Instead of the pressure-sensitive member and the color identifying sensor, the detecting unit 40 may be constituted by a pair of electrodes, and the liquid hit detector may be constituted by an electric-conduction detecting sensor detecting electric conduction between the electrodes when they are hit by coolant. More specifically, a pair of electrodes is provided at a portion hit by coolant, and a certain voltage is applied on one of the electrodes. Then, when coolant is discharged and the coolant hits the pair of electrodes, electric conduction is established between the electrodes. The mechanism is such that the hit of coolant can be verified by detecting electric conduction using another detector. With plural pairs of electrodes placed in a height direction, it becomes possible, by detecting electric conduction between the electrodes arranged at a height at which the coolant hits them, to detect the coolant flow rate.

Based on detection information by the liquid hit detector, various parameters such as the heat radiation amount of the heat radiating unit or the liquid transfer amount of the pump may be controlled. As one example, FIG. 7 is a control flowchart for the arrangement in which the air amount of the fan and the liquid transfer amount of the pump can be controlled based on the coolant flow rate detected by the liquid hit detector.

Figure 7:
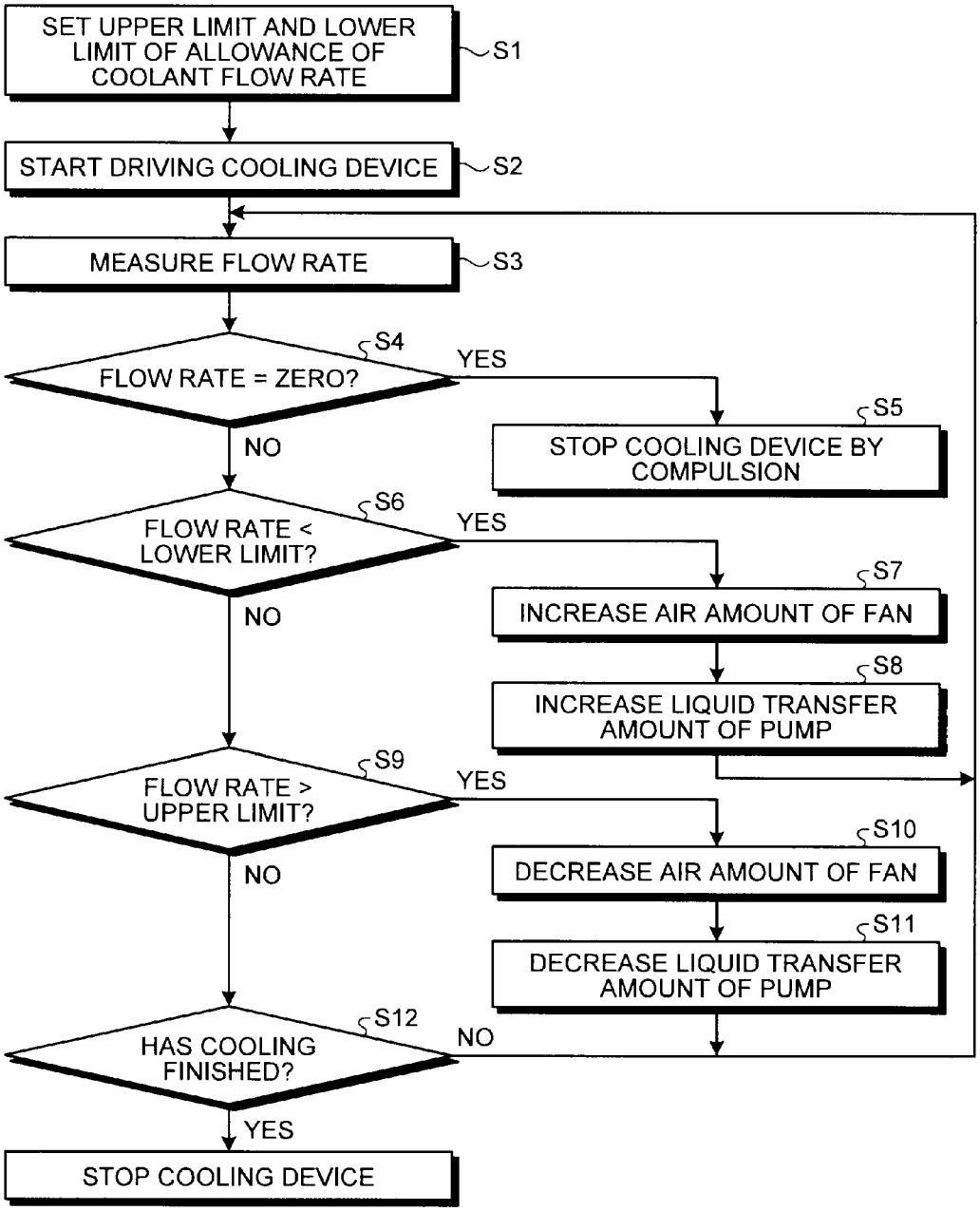
FIG. 7 is a flowchart illustrating an example of control for adjusting the heat radiation amount of a heat radiating unit or the liquid transfer amount of a pump based on detection information by a liquid hit detector.

In the flowchart illustrated in FIG. 7, first, an upper limit and a lower limit of the allowance of the coolant flow rate is set preliminarily (Step S1). Subsequently, the cooling device is driven (Step S2), and the liquid hit detector measures a coolant flow rate (Step S3). Then, it is determined whether the measured flow rate is zero (Step S4). When the flow rate is zero, the cooling device is immediately stopped by compulsion because it can have defects in the pump, circulating paths, etc. (Step S5).

When the flow rate is not zero, it is determined next whether the flow rate is lower than the predetermined lower limit (Step S6). As a result, when the flow rate is lower than the lower limit, the air amount of the fan is increased (Step S7) and then the liquid transfer amount of the pump is increased (Step S8) to improve the cooling capacity.

When the flow rate is not lower than the lower limit, it is determined whether the flow rate exceeds the predetermined upper limit (Step S9). As a result, when the flow rate exceeds the upper limit, the air amount of the fan is decreased (Step S10) and then the liquid transfer amount of the pump is decreased (Step S11) to lower the cooling capacity.

When the air amount of the fan and the liquid transfer amount of the pump are increased or decreased, as described above, the flow rate is measured again (Step S3) and the same process is then repeated until the cooling is finished (Step S12).

In such a way, the air amount of the fan and the liquid transfer amount of the pump are controlled based on the flow rate of coolant, making it possible to appropriately control the temperature of the cooling device and thus improving the reliability of the device. The parameter controlled based on detection results may be any one of the heat radiation amount of the heat radiating unit (the air amount of the fan) and the liquid transfer amount of the pump, or other parameter may be added.

The embodiments of the present invention are described above. However, the present invention is not limited to the above-described embodiments, and it is obvious that various changes may be made without departing from the scope of the present invention. An image forming apparatus having the cooling device of the present invention is not limited to a four-color-tandem electrophotography image forming apparatus with four image forming units placed laterally as illustrated in FIG. 1. The cooling device of the present invention can be mounted on a black-and-white image forming apparatus using a single color, a color image forming apparatus using five or more colors, a copying machine, a printer, a facsimile, an MFP including these, and other electronic devices. The image forming units may be arranged longitudinally, and the positions of other devices such as the intermediate transfer belt, the transferring device, and the fixing device may be also changed appropriately. The position of the cooling device may be also changed appropriately.

In the following, the present invention is described more specifically with reference to an example. However, the present invention is not limited to the following example.

EXAMPLE

In this example, the arrangement of the embodiment illustrated in FIGS. 1 and 2 is adopted.

In the example, the heat receiving unit 31 is constituted by a copper block of 30 mm×330 mm×14 mm having a U-shaped passage with ϕ6 inside. As the heat radiating unit 30, three aluminum-corrugated (with 20 mm in thickness) radiators 33 having a square shape with a side of 120 mm are arranged in series. As the fan 34, an axial flow fan (at a flow velocity of 2.3 m/s) having a square shape with a side of 120 mm, which is the same size as of the radiator 33, is used. A piston micro pump having a resin wetted portion contacting coolant with a shutoff pump head of 25 kPa is used as the pump 32, and a polypropylene tank having a capacity of 900 mL (with a polyethylene cap) is used as the tank 35. The metal pipe 37 is constituted by an aluminum pipe and, instead of the resin tube 38, a rubber tube having the mixed composition of isobutylene-isoprene rubber and EPDM is used here. As coolant, an anti-freeze solution for −30° C.-nonfreezing, composed mainly of propylene glycol and containing a rust-preventive agent, is used. As illustrated in FIG. 2, the liquid transfer pipe 36 is provided in the tank 35, and the detecting unit 40 is arranged on the inner surface of the tank 35 faced by the discharging port 39 of the liquid transfer pipe 36. The liquid transfer amount of coolant by the pump 32 is preliminarily set to 0.5 L/min at a coolant temperature of 34° C.

With the above-described arrangement, using toner with a softening start temperature of 45° C., color duplex printing was continually conducted at a speed of 75 paper sheets per minute for three hours in a room temperature of 32° C. Here, the maximum temperature of the toner of each color in the corresponding developing device resulted in 42° C. for yellow, 42° C. for cyan, 43° C. for magenta, and 43° C. for black, and the temperature of the toner of any color was not higher than its softening start temperature. Consequently, a white-linear image due to the adhesion of toner, which is observed when the toner temperature becomes equal to or higher than its softening start temperature, did not occur. Any abnormal image due to electrical noise did not occur either. During the operation of the cooling device 9, the coolant discharged from the discharging port 39 of the liquid transfer pipe 36 hit the detecting unit 40 and, by visually observing this from the outside of the tank 35, the liquid transfer was able to be verified.

As described above, according to embodiments of the present invention, at the failure examination in the cooling device production process or at the actual use of the cooling device, the situation in which the coolant discharged from the discharging port 39 of the liquid transfer pipe 36 hits the detecting unit 40 is observed visually, and thus liquid transfer can be verified easily. In such a way, the present invention requires no device for monitoring the load current of the pump or a flow meter. Thus, it is possible to achieve, at low cost, easy verification of liquid transfer without requiring any electric power. In the embodiments of the present invention, even if bubbles are mixed into the coolant, there is no possibility of malfunction, unlike the conventional liquid transfer verifying method using an impeller. Thus, the reliability is improved.

When a liquid hit detector for detecting the hit of coolant on the detecting unit 40 is provided, automatic detection is possible without visual observation. Thus, it is possible to save troubles and avoid human errors.

As in the above-described embodiments, the discharging port 39 of the liquid transfer pipe 36 is arranged close to the detecting unit 40. Thus, it becomes possible that the coolant stably hits the detecting unit 40, thereby improving detection accuracy. As illustrated in FIG. 3, etc., with the shorter liquid transfer pipe 36, the hit of the coolant on the detecting unit 40 becomes more stable. Thus, a further improvement of detection accuracy can be expected.

According to the embodiments, liquid transfer can be easily verified by visually observing coolant having flowed into the tank hitting the detecting unit or by detecting the coolant with the liquid hit detector. In this manner, the embodiment does not require a device for monitoring a load current of the pump or a flow meter. Thus, it is possible to achieve easy verification of liquid transfer at low cost. In the embodiment, even if bubbles are mixed into the coolant, there is no possibility of malfunction, unlike the conventional liquid-transfer verifying method using an impeller. Thus, the reliability is improved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A cooling device comprising:

a heat receiving unit arranged to contact with a cooling target to receive heat of the cooling target;

a heat radiating unit configured to radiate heat of coolant;

a tank configured to store therein the coolant;

a circulating path configured to circulate the coolant through the heat receiving unit, the heat radiating unit, and the tank;

a pump configured to transfer the coolant in the circulating path; and a liquid transfer detecting unit configured to detect liquid transfer of the coolant, the liquid transfer detecting unit including a detector arranged above a liquid level of the coolant stored in the tank at a position where the coolant having flowed into the tank hits the detector when the coolant is transferred, the detector being arranged so as to be visible from the outside of the tank.

2. The cooling device according to claim 1, wherein a liquid transfer pipe allowing the coolant to flow into the tank is provided in the tank, a discharging port for discharging the coolant in the liquid transfer pipe is arranged to be close to an inner surface of the tank, and the detector is arranged on the inner surface of the tank facing the discharging port.

3. The cooling device according to claim 2, wherein a part of the inner surface of the tank projects inward so that the detector is arranged on the projecting inner surface.

4. The cooling device according to claim 2, wherein the inner surface of the tank facing the discharging port is inclined in a direction allowing visual observation.

5. The cooling device according to claim 1, wherein the detector includes a liquid splash suppressing unit configured to suppress splash of the coolant hitting the detector.

6. An image forming apparatus comprising the cooling device according to claim 1.

7. A cooling device comprising:

a heat receiving unit arranged to contact with a cooling target to receive heat of the cooling target;

a heat radiating unit configured to radiate heat of coolant;

a tank configured to store therein the coolant;

a circulating path configured to circulate the coolant through the heat receiving unit, the heat radiating unit, and the tank;

a pump configured to transfer the coolant in the circulating path; and a liquid transfer detecting unit configured to detect liquid transfer of the coolant, the liquid transfer detecting unit including a first detector arranged above a liquid level of the coolant stored in the tank at a position where the coolant having flowed into the tank hits the detector when the coolant is transferred and a second detector configured to detect hit of the coolant on the second detector.

8. The cooling device according to claim 7, wherein a liquid transfer pipe allowing the coolant to flow into the tank is provided in the tank, a discharging port for discharging the coolant in the liquid transfer pipe is arranged to be close to an inner surface of the tank, and the detector is arranged on the inner surface of the tank facing the discharging port.

9. The cooling device according to claim 8, wherein a part of the inner surface of the tank projects inward so that the detector is arranged on the projecting inner surface.

10. The cooling device according to claim 7, wherein the first detector includes a pressure-sensitive member that changes color thereof due to pressure generated when being hit by the coolant, and the second detector includes a color identifying sensor for identifying a color change of the pressure-sensitive member.

11. The cooling device according to claim 7, wherein the first detector includes a pair of electrodes, and the second detector includes an electric-conduction detecting sensor for detecting electric conduction between the pair of electrodes when being hit by the coolant.

12. The cooling device according to claim 7, further comprising a mechanism configured to control at least one of a heat radiation amount of the heat radiating unit and a liquid transfer amount of the pump based on detection information by the second detector.

13. The cooling device according to claim 7, wherein the first detector includes a liquid splash suppressing unit configured to suppress splash of the coolant hitting the first detector.

14. An image forming apparatus comprising the cooling device according to claim 7.

* * * * *